US012392104B2

(12) United States Patent
Li et al.

(10) Patent No.: US 12,392,104 B2
(45) Date of Patent: Aug. 19, 2025

(54) DRILLING DEVICE FOR REINFORCED CONCRETE BORED PILE

(71) Applicant: Shandong University, Jinan (CN)

(72) Inventors: Lianxiang Li, Jinan (CN); Chuhan Wang, Jinan (CN); Shangru Zhang, Jinan (CN); Xiuxi Che, Jinan (CN); Yefan Qiu, Jinan (CN); Shilei Zhao, Jinan (CN); Longde Guo, Jinan (CN)

(73) Assignee: Shandong University, Jinan (CN)

( * ) Notice: Subject to any disclaimer, the term of this patent is extended or adjusted under 35 U.S.C. 154(b) by 0 days.

(21) Appl. No.: 18/756,088

(22) Filed: Jun. 27, 2024

(65) Prior Publication Data

US 2025/0101700 A1 Mar. 27, 2025

(30) Foreign Application Priority Data

Sep. 25, 2023 (CN) ..... 202311238194.4

(51) Int. Cl.
*E02D 7/28* (2006.01)

(52) U.S. Cl.
CPC ..... *E02D 7/28* (2013.01)

(58) Field of Classification Search
CPC .. E02D 7/28; E02D 17/04; E02D 5/34; E02D 5/48; E21B 7/04; E21B 7/10; E21B 12/00; E21B 12/04; E21B 17/00
See application file for complete search history.

(56) References Cited

U.S. PATENT DOCUMENTS 4,478,296 A * 10/1984 Richman, Jr. ..... E21B 4/14 175/379

FOREIGN PATENT DOCUMENTS

| | | | | |
|---|---|---|---|---|
| CN | 110656887 A | * | 1/2020 | |
| CN | 214738004 U | * | 11/2021 | |
| CN | 115288610 A | * | 11/2022 | |
| CN | 118911589 A | * | 11/2024 | |
| DE | 102010013725 A1 | * | 10/2011 | ..... E21B 19/20 |

* cited by examiner

*Primary Examiner* — James G Sayre
(74) *Attorney, Agent, or Firm* — Hemisphere Law, PLLC; Zhigang Ma

(57) ABSTRACT

A drilling device for a reinforced concrete bored pile includes drilling masts, a scalable drill rod, a rotary drill bit, a rectangular cutter and scalable cutter rods. A top end of the scalable drill rod is connected to the drilling masts, the rotary drill bit is disposed on a bottom end of the scalable drill rod, the rectangular cutter is disposed above the rotary drill bit and defines a first drill rod hole, the scalable drill rod is disposed to pass therethrough. Bottom ends of the scalable cutter rods are connected to the rectangular cutter, and top ends of the scalable cutter rods are connected to a horizontal constraint platform, on which an impact component is provided. The horizontal constraint platform is disposed below the top end of the scalable drill rod, and the scalable drill rod passes through the horizontal constraint platform and the impact component.

8 Claims, 11 Drawing Sheets

DRILLING DEVICE FOR REINFORCED CONCRETE BORED PILE

TECHNICAL FIELD

The disclosure relates to the technical field of building constructions, and particularly to a drilling device for a reinforced concrete bored pile.

BACKGROUND

Current foundation pit supports generally use temporary support structures, such as pile anchors or pile supports, and support piles are circular reinforced concrete bored piles (i.e., with a circular cross-sections). Reinforced concrete bored piles are piles that are formed in the following manner: directly forming holes on site at the pile position, and then pouring concrete into the holes or placing steel cages and pouring concrete. The reinforced concrete bored piles are a common form, which are generally made by drilling holes on site at the pile position with a drilling rig, then placing the steel cages, and pouring concrete.

In the related art, the reinforced concrete bored piles involve the use of auger drilling machines, which can only form round holes. During the construction process, the existing rectangular hole drilling bits require the replacement of the rectangular hole drilling head after forming the round holes during the construction process, which necessitates readjusting the verticality. This process is complex, inefficient, and the hole width is generally greater than 2 meters, making it unsuitable for the field of permanent support for underground structures.

SUMMARY

The main purpose of the disclosure is to provide a drilling device for a reinforced concrete bored pile, which combines soil cutting and excavation in one, forming a pile hole with an upper rectangular section and a lower circular section in one go during the construction. This improves construction speed, overcomes the drawbacks of traditional rectangular holes that require changing drilling tools and have oversized sections, and is more suitable for the application of vertical components in underground space.

The technical solutions are as follows.

A drilling device for a reinforced concrete bored pile includes drilling masts, a scalable drill rod, a rotary drill bit, a rectangular cutter and scalable cutter rods. A top end of the scalable drill rod is connected to the drilling masts, and the rotary drill bit is disposed on a bottom end of the scalable drill rod. The rectangular cutter is disposed above the rotary drill bit, and the rectangular cutter defines a first drill rod hole, the scalable drill rod is disposed to pass through the first drill rod hole. Bottom ends of the scalable cutter rods are connected to the rectangular cutter, and top ends of the scalable cutter rods are connected to a horizontal constraint platform, on which an impact component is provided. The horizontal constraint platform is disposed below the top end of the scalable drill rod, and the scalable drill rod passes through the horizontal constraint platform and the impact component.

In an embodiment, the drilling masts are provided with a horizontal restriction platform, and the horizontal restriction platform is fixed to the drilling masts. The horizontal restriction platform defines cutting rod holes, the scalable cutter rods are disposed to pass through the cutting rod holes, and a locking component is disposed on the horizontal restriction platform to lock the scalable cutter rods.

In an embodiment, the impact component includes a circumferential inner layer casing vertically disposed at a top of the horizontal constraint platform, a circumferential outer layer casing is vertically disposed at a periphery of the circumferential inner layer casing, a hammer is disposed between the circumferential inner layer casing and the circumferential outer layer casing, and the hammer moves up and down under a driving force of a hammer motor.

In an embodiment, the horizontal constraint platform further defines a second drill rod hole, the scalable drill rod is disposed to pass through the second drill rod hole, the circumferential inner layer casing is disposed at a periphery of the second drill rod hole, the scalable drill rod is disposed to pass through the circumferential inner layer casing and the second drill rod hole, and a bearing is provided between the circumferential inner layer casing and the scalable drill rod.

In an embodiment, a top of the rectangular cutter is provided with plugs protruded upward, the plugs are inserted into groove portions defined at the bottom ends of the scalable cutter rods, respectively, pin holes are defined on side walls of the plugs and side walls of the groove portions, respectively, and pins are inserted into the pin holes, respectively.

In an embodiment, each of the scalable cutter rod includes concentric rod components with multi-layer nested together, and the concentric rod components with multi-layer are capable of extending and retracting along an axial direction.

In an embodiment, the rotary drill bit includes an expansion mechanism.

In an embodiment, a number of the scalable cutter rods is four, and the four scalable cutter rods are disposed in a rectangular shape.

The beneficial effects of the disclosure are as follows.

The disclosure provides a soil cutting system to the existing drilling rig, allowing for the simultaneous construction of rectangular and circular holes, combining soil cutting and excavation in one process. It overcomes the low efficiency issues associated with traditional rectangular hole drilling due to factors such as drill bit replacement and verticality adjustment. It also addresses the cumbersome process of traditional rectangular pile hole drilling. The disclosure enables the one-time formation of a pile hole with an upper rectangular section and a lower circular section during the construction, facilitating the standardization and modularization of the hole formation, and increasing construction speed. The soil cutting system is directionally connected to the rotary drill bit and the drill rods, with verticality adjustment carried out in sync with the drill rod. This overcomes the poor verticality issues of traditional rectangular hole drilling and resolves the drawbacks of secondary verticality verification for traditional rectangular piles, enhancing the smoothness of the pile wall, reducing labor costs, and improving safety.

DETAILED DESCRIPTION OF EMBODIMENTS

To clarify the technical problems to be solved, solutions, and advantages of the disclosure, a detailed description will be provided below in conjunction with the attached drawings and specific embodiments.

Figure 1:
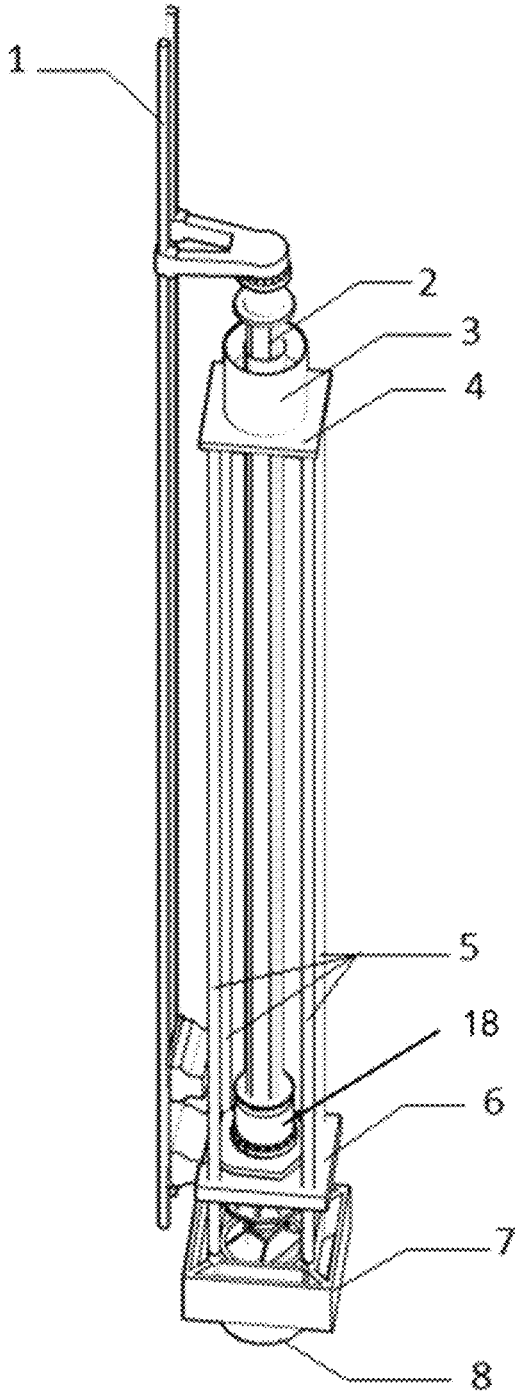
FIG. 1 illustrates an overall schematic structural diagram of a drilling device for a reinforced concrete bored pile of the disclosure.
Figure 2:
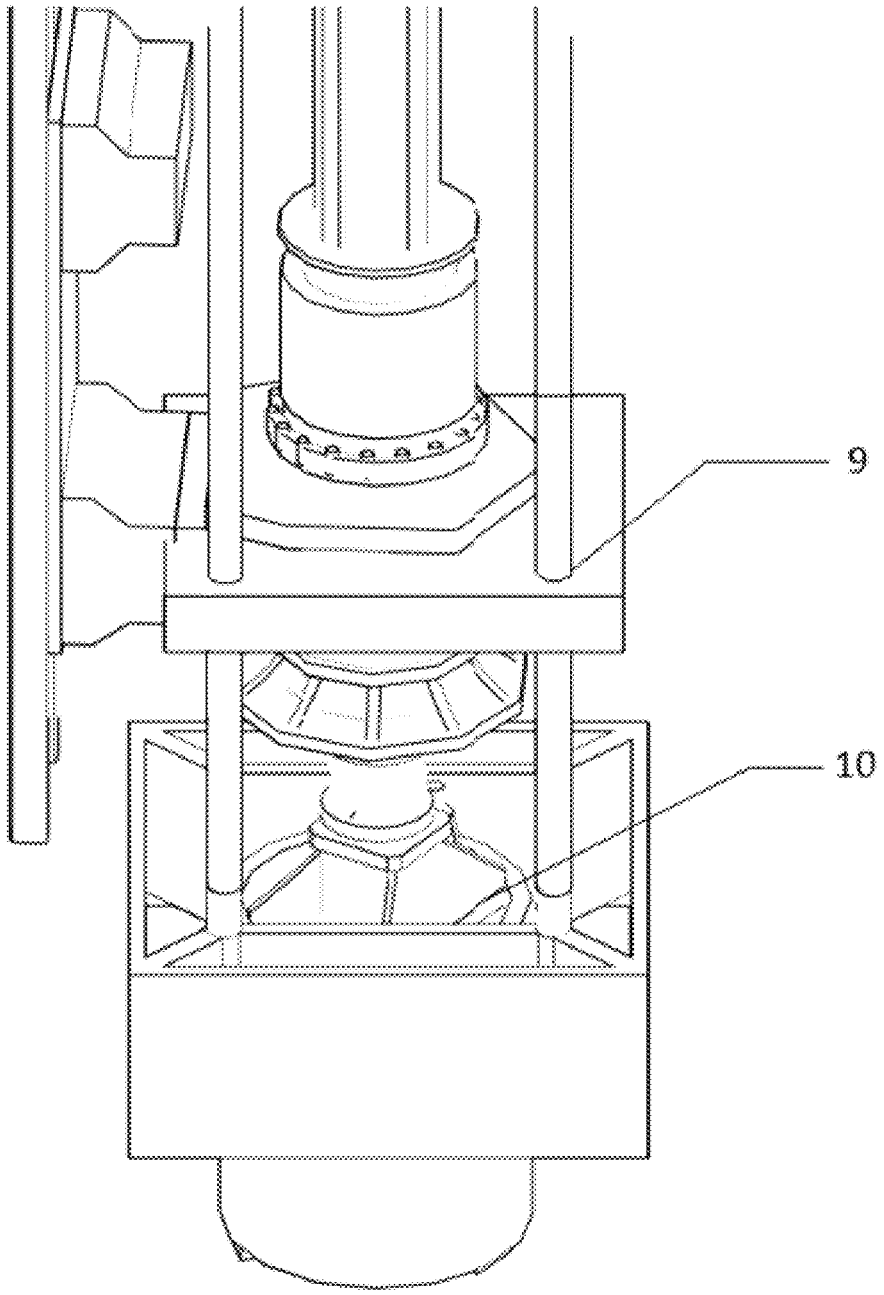
FIG. 2 illustrates an enlarged schematic structural diagram of a bottom of the drilling device for the reinforced concrete bored pile illustrated in FIG. 1 of the disclosure.
Figure 3:
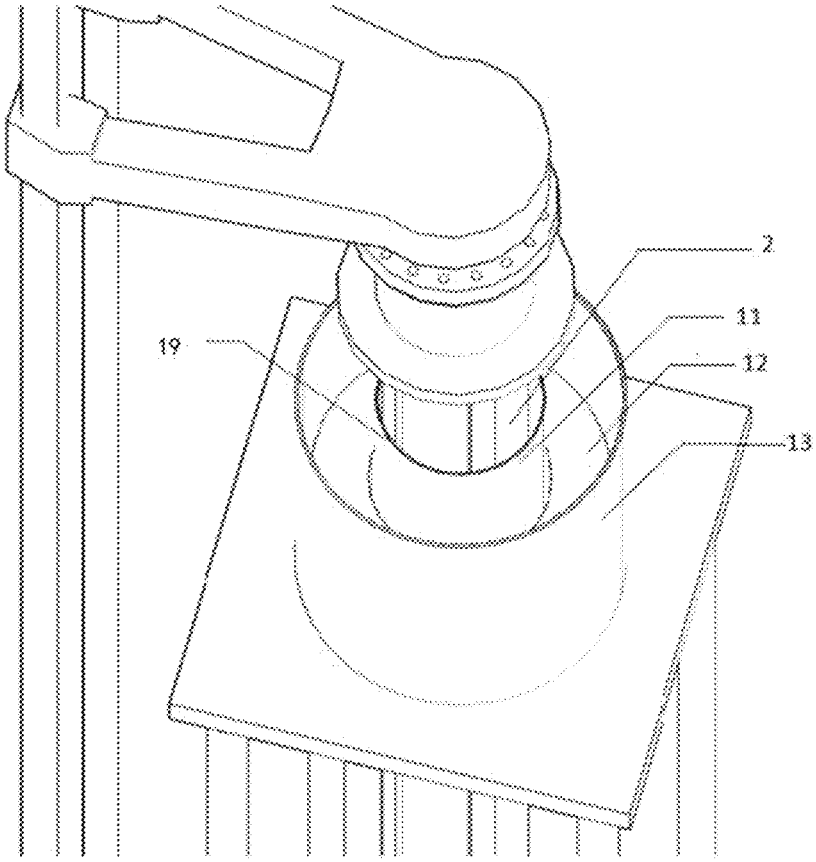
FIG. 3 illustrates an enlarged schematic structural diagram of a top of the drilling device for the reinforced concrete bored pile illustrated in FIG. 1 of the disclosure.
Figure 4:
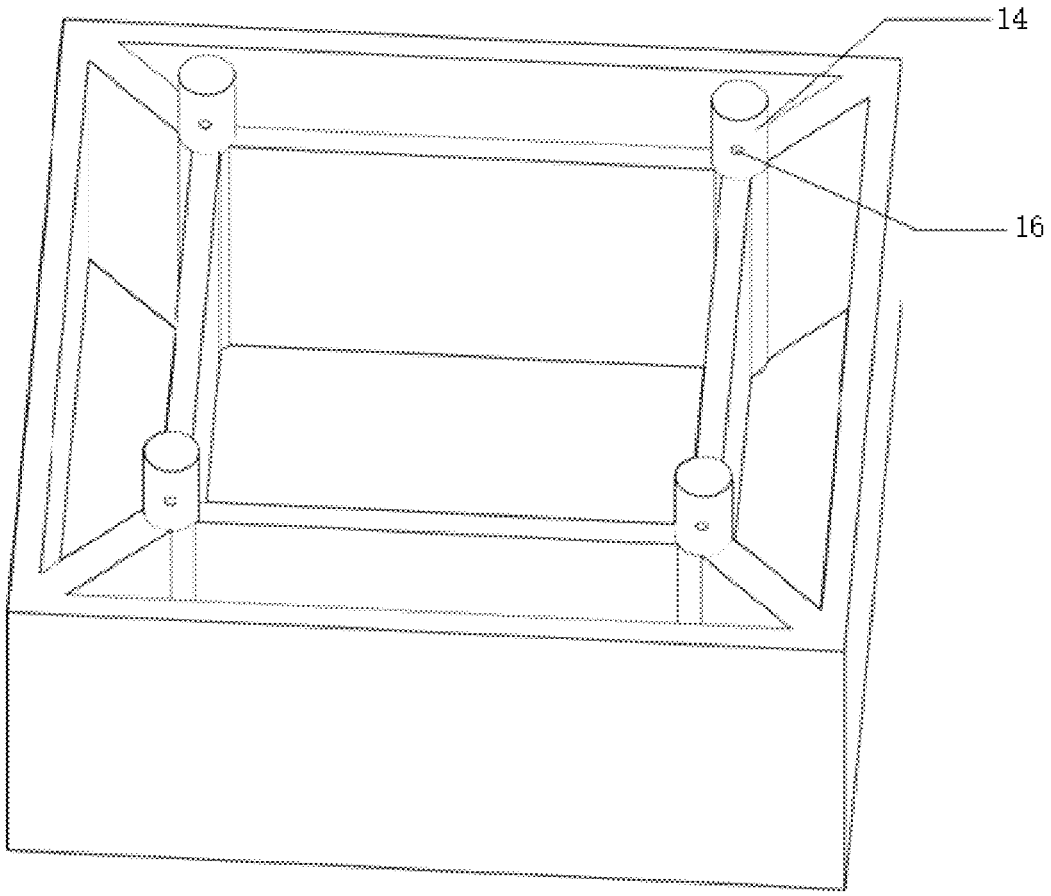
FIG. 4 illustrates a schematic structural diagram of a rectangular cutter of the drilling device for the reinforced concrete bored pile in the disclosure.
Figure 5:
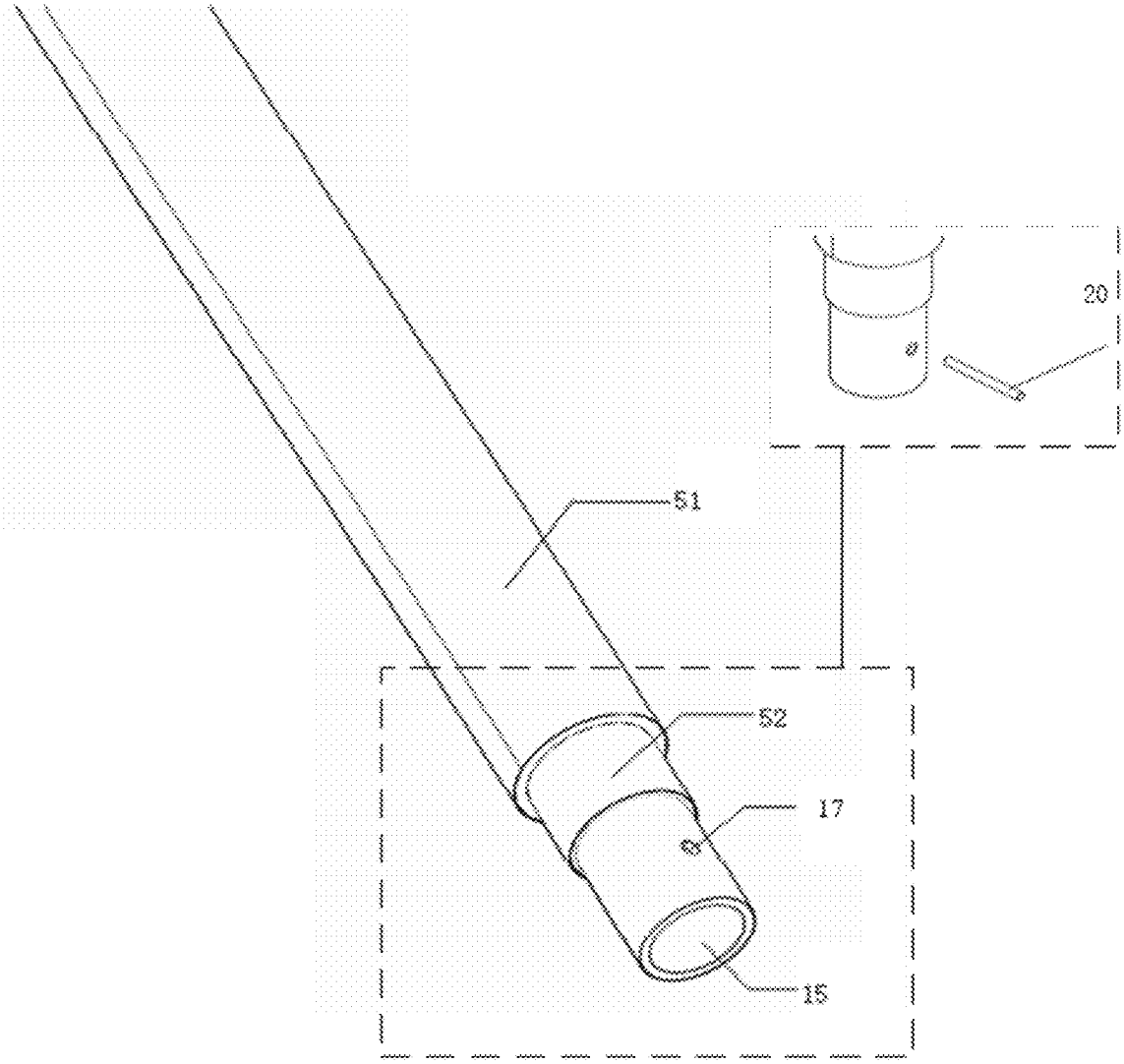
FIG. 5 illustrates a schematic structural diagram of scalable cutter rods after contraction in the disclosure.
Figure 6:
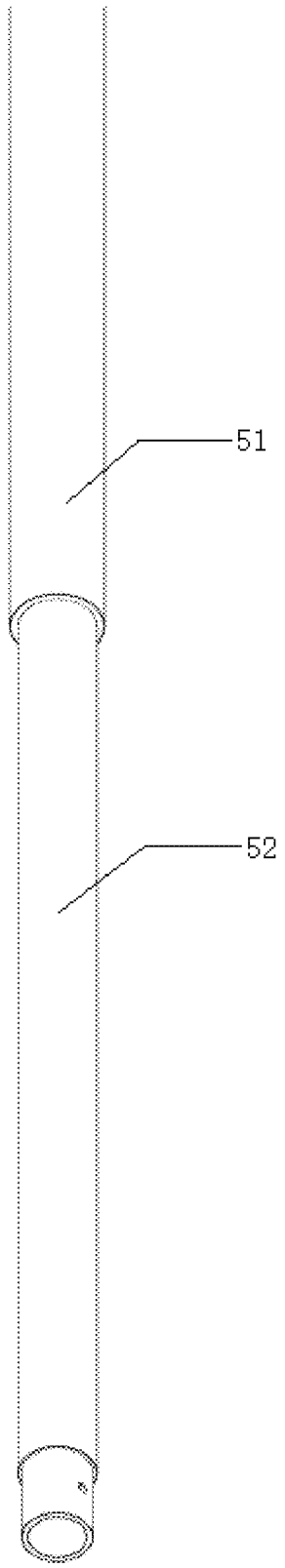
FIG. 6 illustrates a schematic structural diagram of scalable cutter rods after unfolding in the disclosure.
Figure 7:
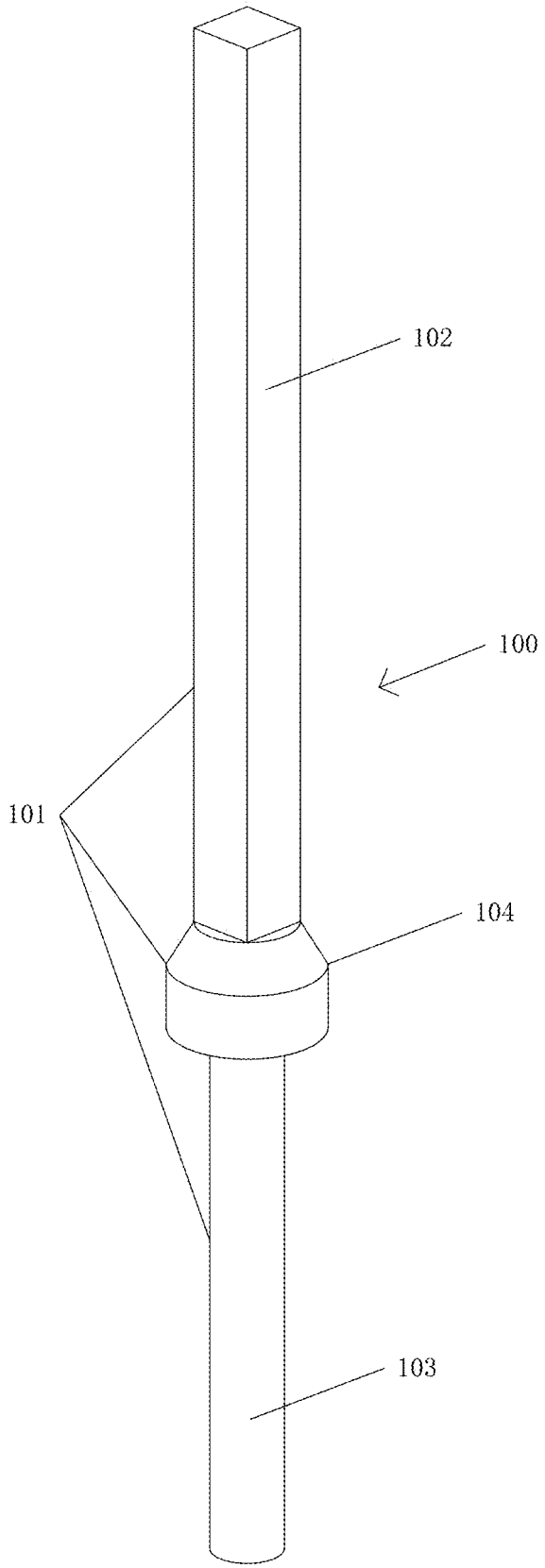
FIG. 7 illustrates a schematic diagram of the reinforced concrete bored pile obtained through a construction of the drilling device of the disclosure.
Figure 8:
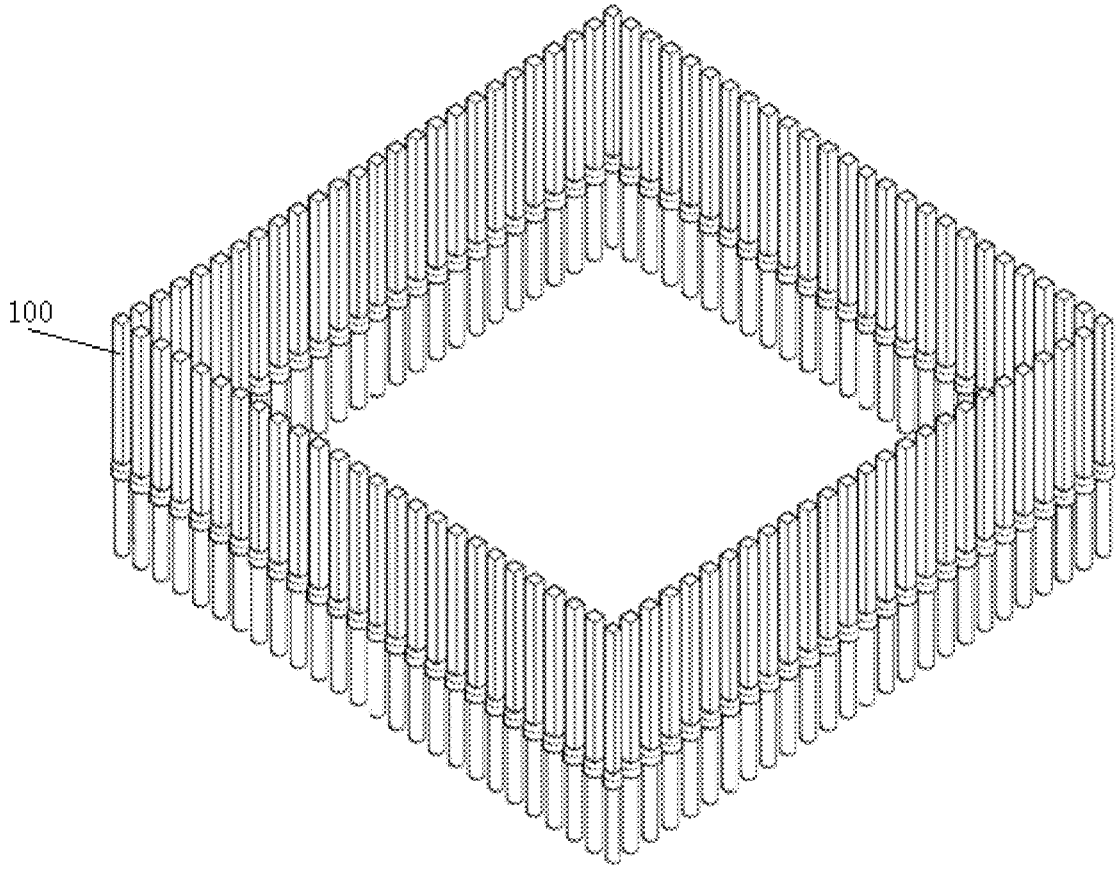
FIG. 8 illustrates a schematic diagram of an arrangement of the reinforced concrete bored piles as pile walls.
Figure 9:
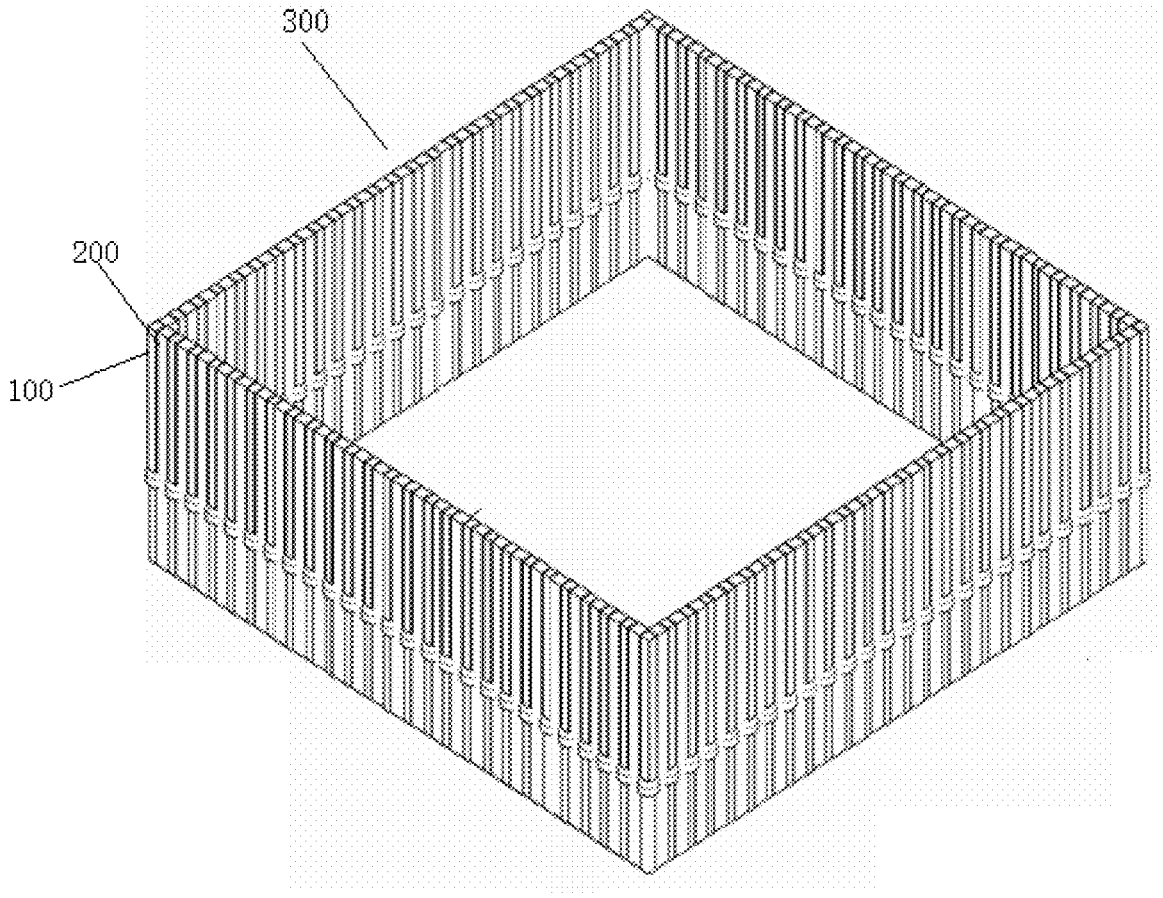
FIG. 9 illustrates a schematic diagram of a permanent support pile wall for a foundation pit.
Figure 10:
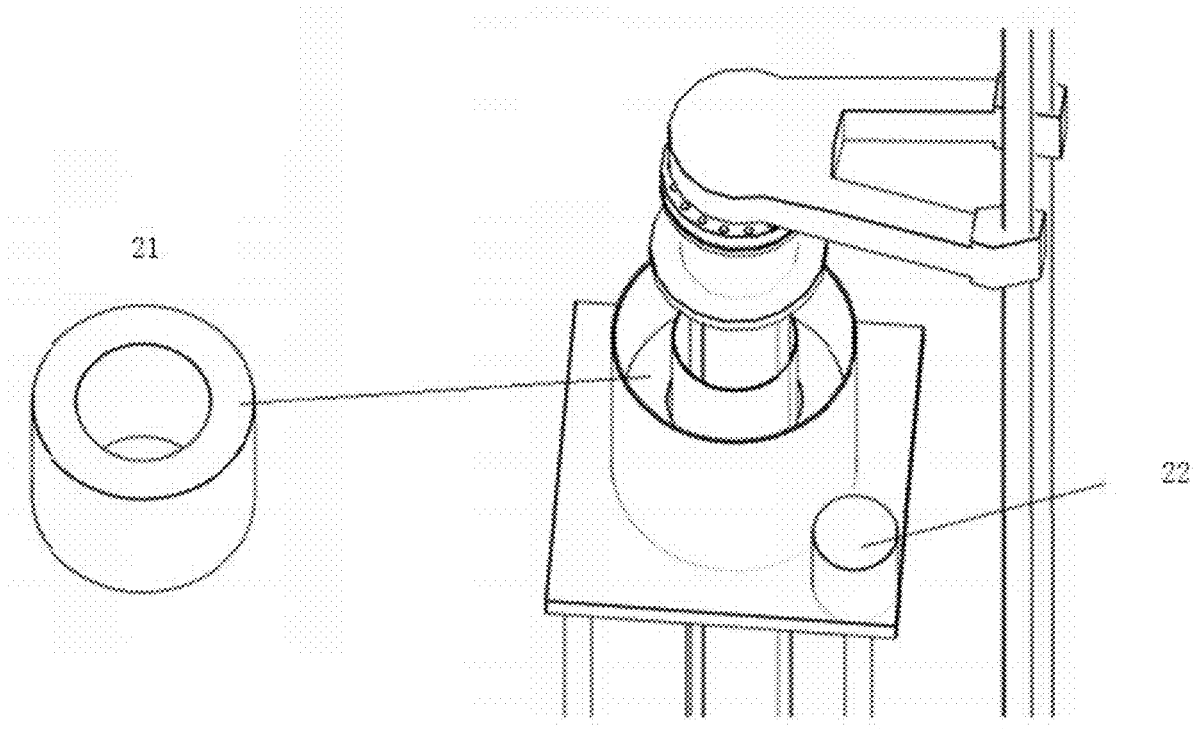
FIG. 10 illustrates a schematic diagram of a hammer and a hammer motor of the drilling device of the disclosure.
Figure 11:
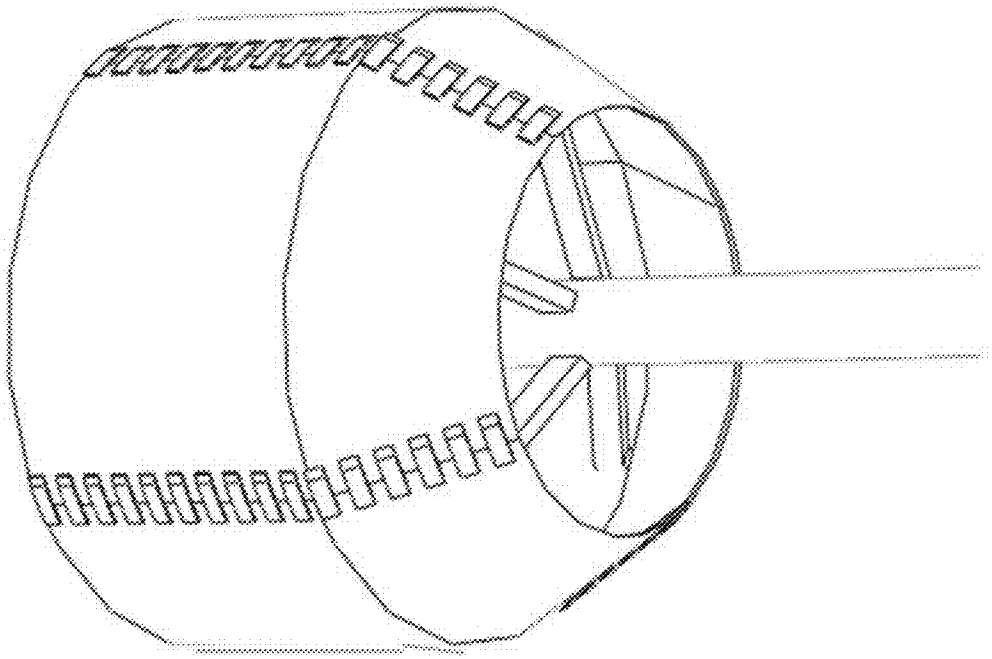
FIG. 11 illustrates a schematic diagram of an expansion mechanism in a close-state of the drilling device of the disclosure.
Figure 12:
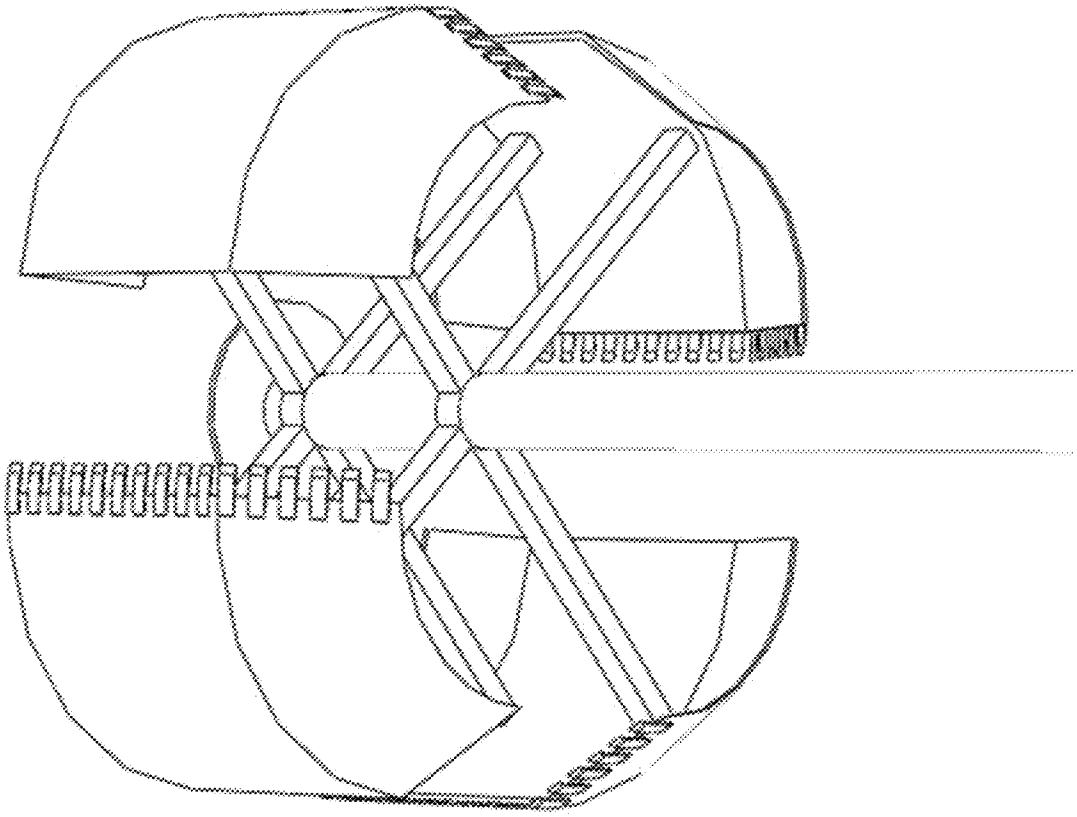
FIG. 12 illustrates a schematic diagram of the expansion mechanism in an open-state of the drilling device of the disclosure.

In an embodiment, as shown in FIGS. 1-9, a drilling device for a reinforced concrete bored pile configured to form a pile hole with an upper rectangular columnar shape and a lower cylindrical shape is provided. The drilling device includes drilling masts 1, a scalable drill rod 2, a rotary drill bit 8, a rectangular cutter 7 and scalable cutter rods 5. The scalable drill rod 2 and the scalable cutter rods 5 adopt a scalable design with adjustable length. A top end of the scalable drill rod 2 is connected to the drilling masts 1, and the rotary drill bit 8 is disposed on a bottom end of the scalable drill rod 2.

The rectangular cutter 7 is disposed above the rotary drill bit 8, the rectangular cutter 7 defines a first drill rod hole 10, the scalable drill rod 2 is disposed to pass through the first drill rod hole 10, and the scalable drill rod 2 moves freely up and down through the first drill rod hole 10.

Bottom ends of the scalable cutter rods 5 are connected to the rectangular cutter 7, and top ends of the scalable cutter rods 5 are connected to a horizontal constraint platform 4, on which an impact component 3 is provided. The horizontal constraint platform 4 is disposed below the top end of the scalable drill rod 2, and the scalable drill rod 2 passes through the horizontal constraint platform 4 and the impact component 3.

In the use of the drilling device, the rotary drill bit 8 starts working first. After a certain depth of the circular hole is excavated, the impact component 3 begins to operate, providing power to the scalable cutter rods 5. Under the impact of the impact component 3, the scalable cutter rods 5 drives the rectangular cutter 7 to move downward, cutting the circular hole formed by the rotary drill bit 8 turning into a rectangular hole. The rotary drill bit 8 and the rectangular cutter 7 work simultaneously, with the cut soil being brought out by the rotary drill bit 8. When the rectangular hole reaches a predetermined depth of the rectangular hole, the rectangular cutter 7 stops working, and the rotary drill bit 8 continues to drill until a predetermined depth of the circular hole is reached, forming a pile hole with an upper rectangular section and a lower circular section. The predetermined depth of each part of the bored pile is determined based on the actual engineering situation. For example, the predetermined depth of rectangular hole and the predetermined depth of circular holes are different.

The disclosure provides a soil cutting system to the existing drilling rig, allowing for the simultaneous construction of rectangular and circular holes, combining soil cutting and excavation in one process. It overcomes the low efficiency issues associated with traditional rectangular hole drilling due to factors such as drill bit replacement and verticality adjustment. It also addresses the cumbersome process of traditional rectangular pile hole drilling. The disclosure enables the one-time formation of a pile hole with an upper rectangular section and a lower circular section during the construction, facilitating the standardization and modularization of the hole formation, and increasing construction speed. The soil cutting system is directionally connected to the rotary drill bit and the drill rods, with verticality adjustment carried out in sync with the drill rod. This overcomes the poor verticality issues of traditional rectangular hole drilling and resolves the drawbacks of secondary verticality verification for traditional rectangular piles, enhancing the smoothness of the pile wall, reducing labor costs, and improving safety.

As an improvement, the rotary drill bit 8 of the disclosure is provided with an expansion mechanism, making the rotary drill bit 8 can expand diameter of the pile holes. The expansion mechanism is used to form an expanded section within the pile hole, where the lateral dimensions of the expanded section are greater than the lateral dimensions of the upper rectangular columnar body and the lower cylindrical body. After the expansion mechanism reaches its predetermined depth, it performs the expansion operation. Under computer control, the rotary drill bit opens and closes its bucket to increase the diameter and carry out the expansion operation until a predetermined diameter of the expanded head is formed. After the expansion operation is completed, the rotary drill bit closes and the operates is proceeded. During the construction process, a three-section pile hole with an upper rectangular section, a middle cylindrical expansion section, and a lower circular section is formed at one time, which can then complete the three-section foundation body with an upper rectangular section, a middle cylindrical expansion section, and a lower circular section.

Furthermore, the middle cylindrical expansion section includes an upper frustum body and a lower cylindrical body. The central axes of the upper frustum and the lower cylindrical body coincide. A diameter of the upper frustum gradually increases from top to bottom, providing a transition in the diameter, and a bottom diameter of the upper frustum is equal to a top diameter of the lower cylindrical body. During the construction process, a four-section pile hole with an upper rectangular section, a middle frustum expansion section and a cylindrical expansion section, and a lower circular section is formed at one time, which can then complete a four-section foundation body with an upper rectangular section, a middle frustum expansion section and a cylindrical expansion section, and a lower circular section.

The drilling masts 1 are provided with a horizontal restriction platform 6, the horizontal restriction platform is fixed to the drilling masts, the horizontal restriction platform 6 defines cutting rod holes 9, the scalable cutter rods 5 is disposed to pass through the cutting rod holes 9, and a locking component 18 is disposed on the horizontal restriction platform 6 to lock the scalable cutter rods 5.

The impact component 3 includes a circumferential inner layer casing 11 vertically disposed at a top of the horizontal constraint platform 4, a circumferential outer layer casing 13 is vertically disposed on a periphery of the circumferential inner layer casing 11, a hammer 21 is disposed in a space 12 between the circumferential inner layer casing 11 and the circumferential outer layer casing 13, and the hammer 21 is configured to move up and down under a driving force of a hammer motor 22.

In the disclosure, the rectangular cutter is configured to cut soil by a method of impact hammer striking. The power part is located at a top of the scalable cutter rods, and the hammer 21 can move up and down between the casings. Under the drive of the motor, it rises to the top (not exceeding heights of the casings) and then falls down. The hammer 21 provides power to the scalable cutter rods by striking, achieving hammer striking pile driving.

The horizontal constraint platform 4 further defines a second drill rod hole 19, the scalable drill rod is disposed to pass through the second drill rod hole 19, the circumferential inner layer casing 11 is disposed at a periphery of the second drill rod hole 19, the scalable drill rod 2 is disposed to pass through the circumferential inner layer casing 11 and the second drill rod hole 19, and a bearing is provided between the circumferential inner layer casing 11 and the scalable drill rod 2. The scalable drill rod 2 can move freely up and down, but the horizontal movement of the scalable drill rod 2 is limited.

The scalable cutter rods 5 and the rectangular cutter 7 are detachable and can be replaced with rectangular cutter of different sizes. Specifically: the scalable cutter rods 5 and the rectangular cutter 7 are connected by a pin method. A top of the rectangular cutter 7 is provided with plugs 14 protruded upward, the plugs 14 are inserted into grooves portions 15 defined at the bottom ends of the scalable cutter rods 5, respectively, pin holes 16 and 17 are defined on side walls of the plugs and side walls of the groove portions, respectively, and pins 20 are inserted into the pin holes 16 and 17, respectively. The pins 20 are inserted into the pin holes 16 and 17 to prevent them from falling off.

Each of the scalable cutter rod 5 includes concentric rod components with multi-layer 51 and 52 nested together, and the concentric rod components with multi-layer 51 and 52 are capable of extending and retracting along an axial direction. For example, two concentric rod components with multi-layer of the outermost drilling rod 51 and the inner drilling rod 52 are provided. The inner drilling rod 52 is retracted inside the outermost drilling rod 51. When the scalable cutter rods are pressed to its maximum length, the scalable cutter rods are lifted, and the inner drilling rod extends. After being secured, continue to press down to cut the soil. During the pressing process, the inner drilling rod keeps vertical at all times.

In an embodiment, a number of the scalable cutter rods 5 is four, and the four scalable cutter rods 5 are disposed in a rectangular shape.

In an embodiment, the disclosure is used to form a reinforced concrete bored pile 100 with an upper rectangular section and a lower circular section. The pile body 101 includes an upper pile section 102 and a lower pile section 103. The upper pile section 102 is a rectangular column shape, with its cross-sectional shape being rectangular, specifically square. The lower pile section 103 is a cylindrical shape, with its cross-sectional shape being circular.

Between the upper pile section 102 and the lower pile section 103, there is an expansion section 104, and cross-sectional dimensions of the expansion section 104 are larger than the cross-sectional dimensions of the upper pile section 102 and the lower pile section 103.

The upper pile section 102, the expansion section 104, and the lower pile section 103 are sequentially disposed from top to bottom inside the pile hole along a central axis, and they are formed as a whole.

The disclosure configures the reinforced concrete bored pile 100 into three parts, forming a pile body with variable cross-sections. The cross-section of the upper pile section 102 is rectangular, the purpose of which is to facilitate connection with subsequent underground structures (such as beams, slabs, and other structures), serving as part of the structure and bearing horizontal and vertical forces. The expansion section 104 in the middle and lower part can effectively cope with the maximum bending moment in the pile body. Below the expansion section 104 is the lower pile section 103 with a circular cross-section, which is convenient and fast to construct, effectively saving materials and construction time.

The reinforced concrete bored pile 100 can be used as a foundation pit support pile, for example, in deep foundation pit projects with a depth greater than 10 meters that use permanent support pile walls. During the excavation process of the foundation pit, the drilling device of the disclosure serves as a support pile, disposed in intervals to form a row of piles. Between the reinforced concrete bored piles 100 are cement-soil mixing piles 200 (also known as cement-soil mixing walls), which serve to prevent water seepage and other functions. The drilling device of the disclosure combines the reinforced concrete bored piles 100 with the cement-soil mixing walls 200 to jointly form a deep foundation pit permanent support pile walls 300 that is conducive to controlling verticality and smoothness, integrating water prevention and support in one.

This disclosure changes the structural form of the traditional cylindrical reinforced concrete bored pile, adopting the variable cross-sections with an upper rectangular columnar body and a lower cylindrical body, and an expansion section between them, forming a variable cross-section pile body. The upper rectangular columnar body, after construction, is exposed above the bottom of the foundation pit and connected as a whole with the upper frame structure, serving as a load-bearing component. The middle and lower expansion section and the lower cylindrical body are buried below the bottom of the foundation pit.

The disclosure takes advantage of the rectangular columnar shape of the upper part of the pile to improve the verticality and smoothness of the permanent foundation pit of support wall. It facilitates subsequent treatment of local defects, eliminating the need for smoothness finishing in the subsequent construction process. It can be directly connected to the waterproof structure, reducing the workload for subsequent treatment of unevenness of the permanent support structure wall, and facilitating waterproof construction. When used as a permanent foundation pit of support wall, it can be directly connected to beam and slab structures without the need for smoothness treatment, eliminating redundant steps, and reducing the deviation of smoothness and verticality of existing cylindrical piles, thus improving the level of smoothness of the permanent support wall. Additionally, the upper part of the pile experiences a larger bending moment, and the bending resistance coefficient of a rectangular cross-section is greater than that of a circular cross-section under the same cross-sectional area. Therefore, the rectangular cross-section of the upper pile body set up can withstand a larger bending moment.

The disclosure utilizes an expansion section to enlarge the cross-section of the pile body over a certain length near the bottom of the foundation pit, correspondingly and specifically enhancing the maximum bending moment of the support pile body at the bottom of the foundation pit. It optimizes the section and embedment depth of the fixation end, thereby optimizing the pile body section and its stiffness from a force perspective. This is beneficial for bearing the maximum bending moment of the pile body, achieving specificity, applicability, and scientificity, and enhancing the horizontal support capacity of the pile body. On one hand, the horizontal bending resistance and settlement resistance of the drilling device of the disclosure are further enhanced compared to existing support piles. On the other hand, it improves the material utilization efficiency of the pile body, adapts to the force pattern of the support piles, and saves materials.

The above is a specific embodiment of the disclosure. It should be pointed out that for those skilled in the art, several improvements and embellishments can be made without departing from the principles of the disclosure, and these improvements and embellishments should also be considered within the scope of protection of the disclosure.

What is claimed is:

1. A drilling device for a reinforced concrete bored pile, comprising: drilling masts, a scalable drill rod, a rotary drill bit, a rectangular cutter, and scalable cutter rods;

wherein a top end of the scalable drill rod is connected to the drilling masts, and the rotary drill bit is disposed on a bottom end of the scalable drill rod; the rectangular cutter is disposed above the rotary drill bit, the rectangular cutter defines a first drill rod hole, the scalable drill rod is disposed to pass through the first drill rod hole; bottom ends of the scalable cutter rods are connected to the rectangular cutter, and top ends of the scalable cutter rods are connected to a horizontal constraint platform, on which an impact component is provided; the horizontal constraint platform is disposed below the top end of the scalable drill rod, and the scalable drill rod passes through the horizontal constraint platform and the impact component.

2. The drilling device for the reinforced concrete bored pile as claimed in claim 1, wherein the drilling masts are provided with a horizontal restriction platform, and the horizontal restriction platform is fixed to the drilling masts; the horizontal restriction platform defines cutting rod holes, the scalable cutter rods are disposed to pass through the cutting rod holes, and a locking component is disposed on the horizontal restriction platform to lock the scalable cutter rods.

3. The drilling device for the reinforced concrete bored pile as claimed in claim 2, wherein the impact component comprises a circumferential inner layer casing vertically disposed at a top of the horizontal constraint platform, a circumferential outer layer casing is vertically disposed at a periphery of the circumferential inner layer casing, a hammer is disposed between the circumferential inner layer casing and the circumferential outer layer casing, and the hammer is configured to move up and down under a driving force of a hammer motor.

4. The drilling device for the reinforced concrete bored pile as claimed in claim 3, wherein the horizontal constraint platform further defines a second drill rod hole, the scalable drill rod is disposed to pass through the second drill rod hole, the circumferential inner layer casing is disposed at a periphery of the second drill rod hole, and the scalable drill rod is disposed to pass through the circumferential inner layer casing and the second drill rod hole.

5. The drilling device for the reinforced concrete bored pile as claimed in claim 4, wherein a top of the rectangular cutter is provided with plugs protruded upward, the plugs are inserted into groove portions defined at the bottom ends of the scalable cutter rods, respectively, pin holes are defined on side walls of the plugs and side walls of the groove portions, respectively, and pins are inserted into the pin holes, respectively.

6. The drilling device for the reinforced concrete bored pile as claimed in claim 5, wherein each of the scalable cutter rod comprises concentric rod components nested together, and the concentric rod components are capable of extending and retracting along an axial direction.

7. The drilling device for the reinforced concrete bored pile as claimed in claim 1, wherein the rotary drill bit comprises an expansion mechanism.

8. The drilling device for the reinforced concrete bored pile as claimed in claim 7, wherein a number of the scalable cutter rods is four, and the four scalable cutter rods are disposed in a rectangular shape.

* * * * *